US008402794B2

(12) United States Patent
Sasur

(10) Patent No.: US 8,402,794 B2
(45) Date of Patent: Mar. 26, 2013

(54) HINGED KNITTING LOOM

(75) Inventor: David Sasur, Ludlow, MA (US)

(73) Assignee: Simplicity Pattern Co. Inc., Antioch, TN (US)

( * ) Notice: Subject to any disclaimer, the term of this patent is extended or adjusted under 35 U.S.C. 154(b) by 0 days.

(21) Appl. No.: 13/217,503

(22) Filed: Aug. 25, 2011

(65) Prior Publication Data

US 2012/0047960 A1 Mar. 1, 2012

Related U.S. Application Data

(60) Provisional application No. 61/376,917, filed on Aug. 25, 2010.

(51) Int. Cl.
*D04B 5/00* (2006.01)

(52) U.S. Cl. ..... 66/3

(58) Field of Classification Search ..... 66/1 A, 66/3, 4

See application file for complete search history.

(56) References Cited

U.S. PATENT DOCUMENTS

| | | | | | |
|---|---|---|---|---|---|
| 1,318,604 | A | * | 10/1919 | Schneider | 66/4 |
| 1,500,383 | A | * | 7/1924 | Gourie | 66/4 |
| 1,694,849 | A | * | 12/1928 | Fujii | 66/4 |
| 1,705,860 | A | * | 3/1929 | Hagihara | 66/4 |
| 2,072,668 | A | | 7/1936 | Eltgroth | |
| 2,457,064 | A | * | 12/1948 | Parisl | 66/4 |
| 3,967,467 | A | | 7/1976 | Leach, Sr. | |
| 4,193,273 | A | * | 3/1980 | Palange | 66/4 |
| 4,246,768 | A | * | 1/1981 | Palange | 66/4 |
| 4,248,063 | A | | 2/1981 | Wang | |
| 4,393,668 | A | | 7/1983 | Leach, Sr. | |
| 4,729,229 | A | * | 3/1988 | Whicker | 66/4 |
| 5,125,245 | A | | 6/1992 | Kuwabara | |
| 5,231,742 | A | * | 8/1993 | Macbain | 28/151 |
| 5,413,150 | A | * | 5/1995 | Townsend | 139/34 |
| 5,542,268 | A | * | 8/1996 | Palange | 66/1 R |
| 5,577,400 | A | * | 11/1996 | Palange | 66/4 |
| 6,810,697 | B2 | * | 11/2004 | Sangiacomo | 66/148 |
| 7,506,524 | B2 | | 3/2009 | Gustin | |
| 7,578,146 | B2 | | 8/2009 | Gustin | |
| 2008/0156043 | A1 | * | 7/2008 | Gustin | 66/4 |
| 2008/0223083 | A1 | * | 9/2008 | Gustin | 66/1 A |
| 2012/0047960 | A1 | * | 3/2012 | Sasur | 66/1 A |

FOREIGN PATENT DOCUMENTS

GB 2147918 A * 5/1985

OTHER PUBLICATIONS

International Search Report with Written Opinion corresponding to PCT/US2011/049059, dated Dec. 8, 2011, 11 pages.

* cited by examiner

*Primary Examiner* — Danny Worrell

(74) *Attorney, Agent, or Firm* — Pillsbury Winthrop Shaw Pittman, LLP

(57) ABSTRACT

Disclosed is a convertible knitting loom that includes a first body and a second body that are connected via a hinge so that the bodies can rotate relative to each other and used in more than one configuration. Each body includes knitting pegs for weaving and knitting yarn. The first and second bodies are configured to be provided in at least first (closed) configuration such that the first body and the second body are parallel to each other and a second (open, linear) configuration such that the bodies are substantially linearly aligned. A removable fastener or lock pin can be used to lock the bodies of the loom in either the first or second configuration.

18 Claims, 4 Drawing Sheets

HINGED KNITTING LOOM

RELATED APPLICATION

The present application is related to U.S. Provisional Patent Application Serial No. 61/376,917, filed Aug. 25, 2010, entitled "Hinged Knitting Loom," which is hereby incorporated by reference herein in its entirety.

BACKGROUND

1. Field

The present disclosure relates a hand held knitting loom for knitting garments and other items.

2. Description of Related Art

Circular and rectangular knitting looms with a plurality of knitting pegs extending upwardly from the base and having a one-piece, solid base structure are generally known, as illustrated by U.S. Pat. No. 7,506,524.

SUMMARY

One aspect of the disclosure provides a knitting loom including: a base structure having a first part and a second part, the first part extending in a longitudinal direction having a first end and a second end and having a plurality of knitting pegs provided between the first end and the second end, and the second part extending in a longitudinal direction having a third end and a fourth end and having a plurality of knitting pegs provided between the third end and the fourth end. The first end of the first part and the third end of the second part are hingedly connected together by a hinge such that the first part and the second part are configured to move relative to each other such that the knitting loom is positioned in either in a first configuration wherein the first part and the second part are parallel to each other or a second configuration wherein the first part and the second part are provided at an angle relative to each other.

Another aspect of the disclosure includes a knitting loom including: a first body extending in a longitudinal direction having a first end and a second end and having a plurality of knitting pegs extending therefrom, a second body extending in a longitudinal direction having a third end and a fourth end and having a plurality of knitting pegs extending therefrom, and a hinge connecting the first body and the second body. The first body and the second body are configured to rotate relative to each other via the hinge. The first body and the second body are configured to be provided in a closed configuration such the first body and the second body are parallel to each other and configured to be provided in an open, linear configuration wherein the first body and the second body are substantially linearly aligned. In the closed configuration, the second end of the first body and the fourth end of the second body are locked in the closed configuration using a removable lock pin. In the open, linear configuration, the first end of the first body and the third end of the second body are locked in the open, linear configuration using the removable lock pin.

Other features and advantages of the present disclosure will become apparent from the following detailed description, the accompanying drawings, and the appended claims.

DETAILED DESCRIPTION

Figure 2:
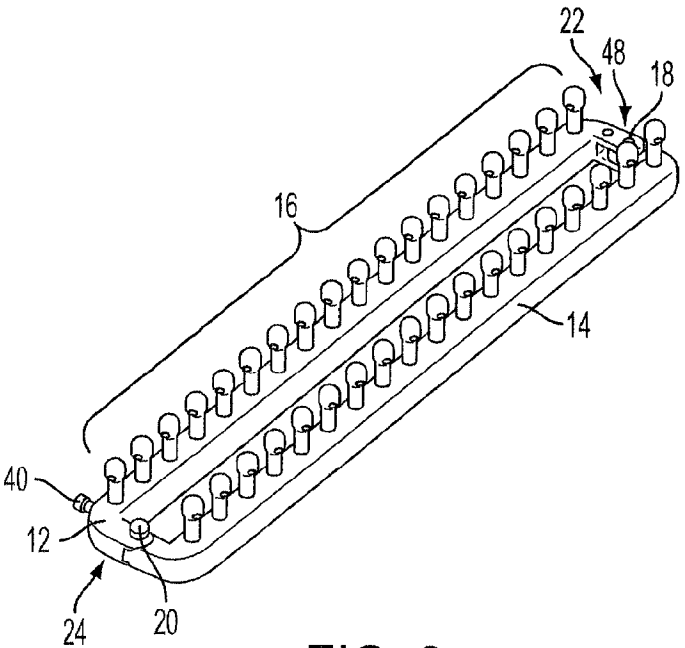
FIGS. 2 and 3 show perspective views of the knitting loom of the present disclosure in a second configuration (or closed position) in accordance with an embodiment.

Between the figures and the description herebelow, there is shown and described a hand held, hinged knitting loom for knitting garments and other items using yarn (or other material) that is convertible and configured for use in more than one position. As referenced herein, "yarn" refers to a flexible material suitable for weaving, such as commercially available twines and yarn.

Referring to the figures, FIGS. 1-4 illustrate a knitting loom having a base structure 10 formed from a first part 12 or body (or first side) and a second part 14 or body (or second side). As described in detail below, the first and second parts 12 and 14 are connected via a hinge 48 at one end 22 of the base structure 10 and have a removable connection at an opposed end 24. The parts of the knitting loom are convertible and configured to be positioned in a first (closed) or second (open) configuration for knitting an item.

More specifically, the first part 12 of the knitting loom extends in a longitudinal direction and has its own first end 26 and a second end 28. The second part 14 of the knitting loom extends in a longitudinal direction and has a third end 30 and a fourth end 32. The first part 12 has a plurality of knitting pegs 16 provided between the first end 26 and the second end 28 and extending upwardly from its body. The second part 14 also has a plurality of knitting pegs 16 provided between the third end 30 and the fourth end 32 and extending upwardly from its body. As understood in the art, a user can wrap yarn about pegs 16 in a variety of directions and patterns to knit a desired item. Each of the pegs 16 comprises a body portion 34 and a top portion 36. A notch 38 is associated with each of the pegs 16 for assistance during knitting. For example, the notches 38 can assist in catching the yarn or material during weaving of an item. Any number of knitting pegs may be provided in first and second parts 12 and 14. In one embodiment, each part 12, 14 has approximately eighteen (18) knitting pegs associated therewith. However, any number N of knitting pegs may be provided.

The plurality of knitting pegs 16 can be spaced substantially equidistant relative to one another. In an embodiment, they are substantially equidistant around a perimeter of the base structure 10. "Substantially equidistant" refers to any two adjacent knitting pegs that are spaced apart by a substantially equal distance (on either or both sides).

The base structure 10 also includes at least one yarn attachment point 40, which may be in the form of an end peg, located on at least one end of the base structure 10. Yarn attachment point 40 is used to holding an end of a piece of yarn in place when initiating knitting.

Figure 7:
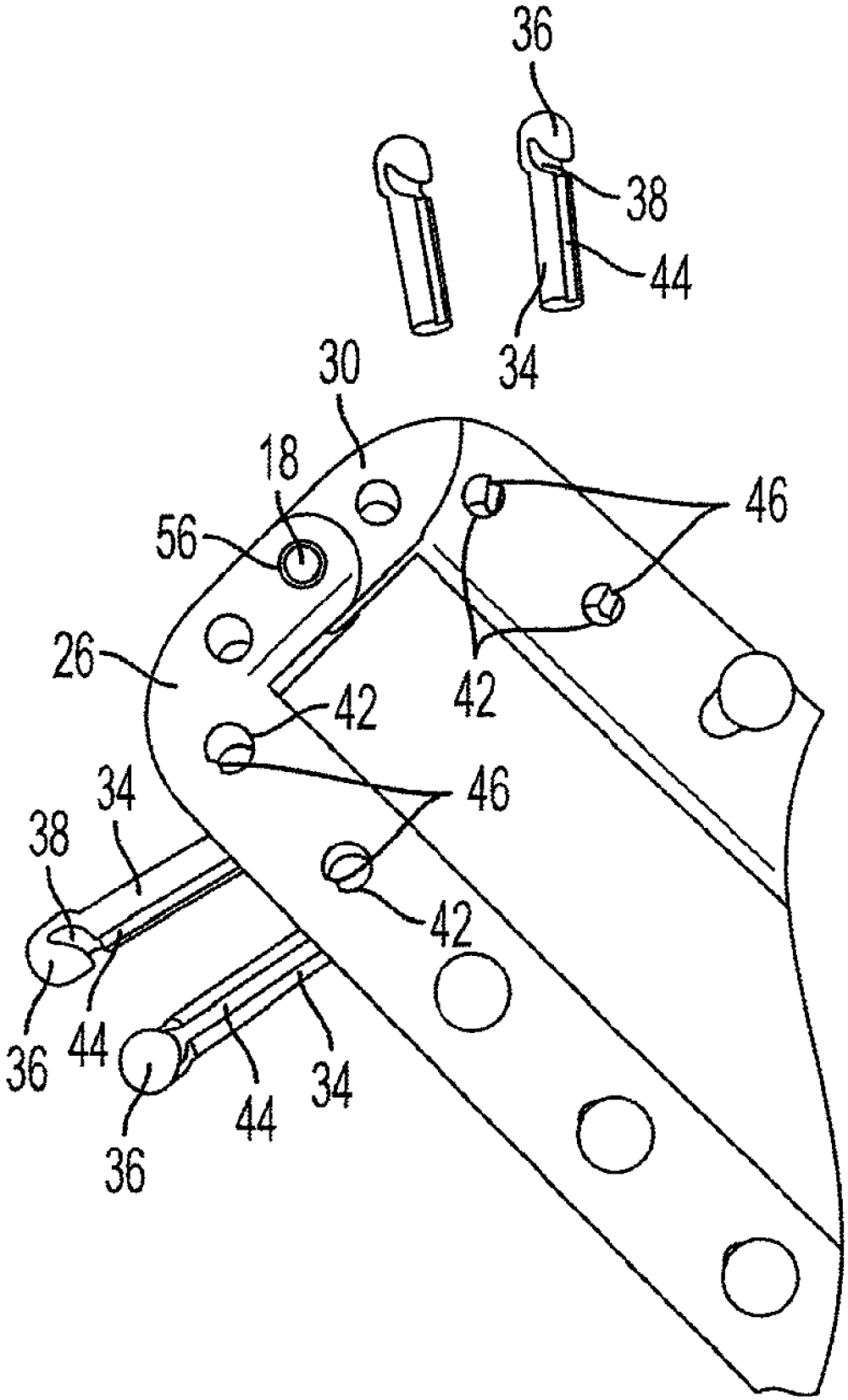
FIG. 7 illustrates a detailed, top view of the knitting loom with knitting pegs removed from its base structure.

In an embodiment, knitting pegs 16 are removable, as shown greater detail in FIG. 7. That is, the plurality of knitting pegs 16 are removably connected to their respective parts 12 or 14. The removable knitting pegs 16 can allow for adjustments in the amount of pegs extending upwardly from the base structure 10, which in turn can affect a length of an item or object being knit, for example. The knitting pegs may be removed from either or both parts 12 and/or 14 of base structure 10. In an embodiment, the parts 12 and 14 may comprise openings 42 that are substantially equidistant from each other and that are configured to receive knitting pegs 16 therein (e.g., so that the knitting pegs 16 may be spaced equidistant relative to each other). The openings 42 are configured to hold the pegs 16 tightly in place. In an embodiment, the openings 42 and bodies 34 of knitting pegs 16 comprise complimentary shapes. For example, the openings 42 and bodies 34 may be shaped such that when the knitting pegs are inserted into the base structure 10, they are positioned such that each of their respective notches 38 are ready for use and so that there is a substantially tight fit. Optionally, in one embodiment, each of the knitting pegs 16 may have a groove or channel 44 configured to align and receive a protrusion 46 within each of the openings 42 (or vice versa).

However, the pegs 16 need not be removable. For example, the pegs 16 may be configured to be permanently attached to the base structure 10 (e.g., using attachment devices, such as adhesive) and/or formed integrally therewith.

As will be recognized by a person of ordinary skill in the art, the base structure 10 and parts of the knitting loom may be of any desirable size and may contain any number of knitting pegs. In addition, the loom may be made of any suitable material, such as wood, plastic, rubber, or metal.

Figure 3:
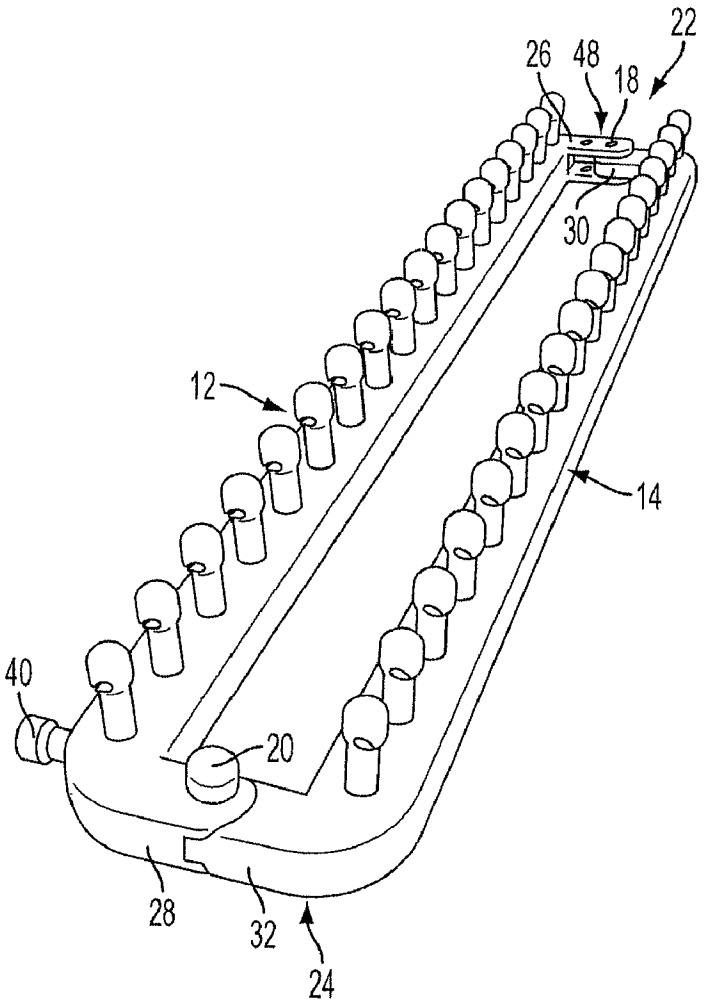

FIGS. 2 and 3 show the knitting loom in a first (closed) configuration wherein the first part 12 and the second part 14 are parallel to each other. In this first (closed) configuration, the plurality of knitting pegs 16 form two substantially parallel rows for knitting. The first part and the second part have a space therebetween in the first (closed) configuration to allow for knitted material to be received between the parts 12 and 14 (e.g., during the process of knitting an item).

The knitting loom is also configured to be positioned in a second (open) configuration. In the second configuration, the first part 12 and the second part 14 are provided at an angle relative to each other. The parts 12 and 14 may be provided at any angle relative to each other, and any angle between the parts is not meant to be limiting. For explanatory purposes only, the loom is further described herein as being positioned in an open, linear configuration, e.g., the parts 12 and 14 are positioned with an angle of approximately 180 degrees therebetweeen. However, it should be understood that the parts of the knitting loom can be positioned at other angles relative to each other, and that other configurations for knitting (e.g., a triangle configuration) can also be implemented using the disclosed knitting loom.

Figure 4:
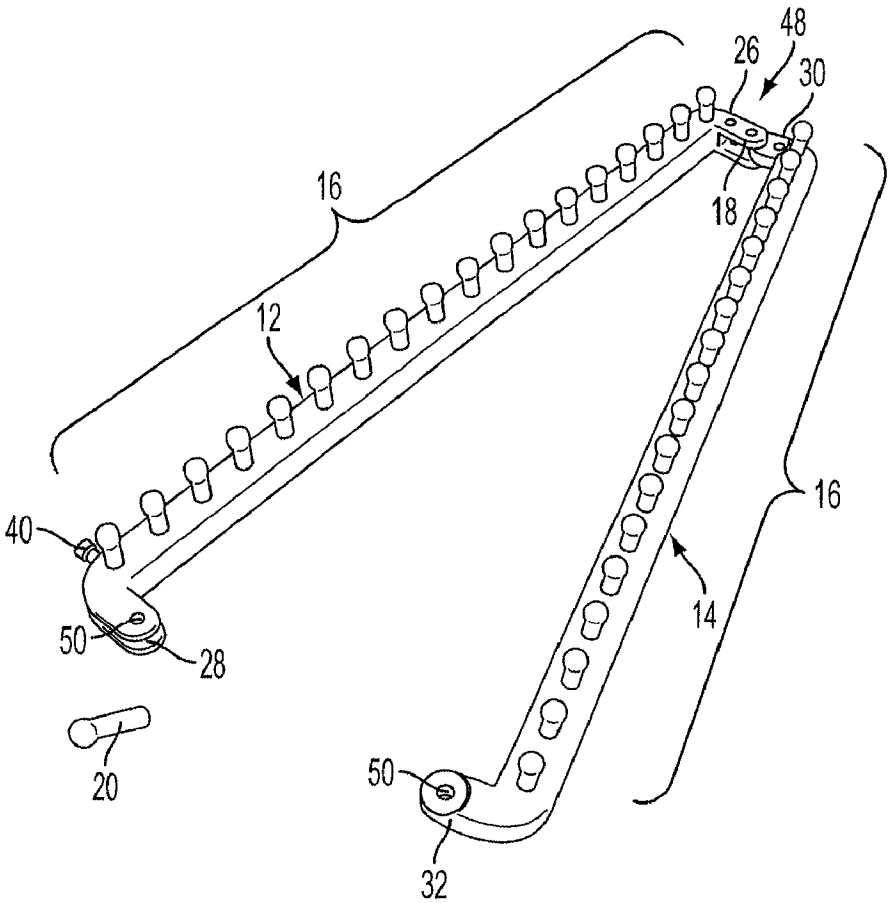
FIG. 4 illustrates a perspective view of the knitting loom in a partially open position with a removable fastener.

In order to move the first and second parts 12 and 14 relative to one another (from the first (closed) configuration to a second (open) configuration), in one embodiment, the second end 28 of the first part 12 and the fourth end 32 of the second part 14 are configured to be disconnected. For example, as shown in FIG. 4, a removable fastener 20 may be provided that is configured to be removed and allow separation of the second end 28 of first part 12 and fourth end 32 of second part 14 at the opposed end 24 of base structure. The removable fastener may be in the form of a lock pin, for example. When the removable fastener 20 is attached to/inserted into the base structure 10, it holds the first and second parts 12 and 14 in the first (closed) configuration. When removed, the opposed end 24 can be opened.

Figure 5:
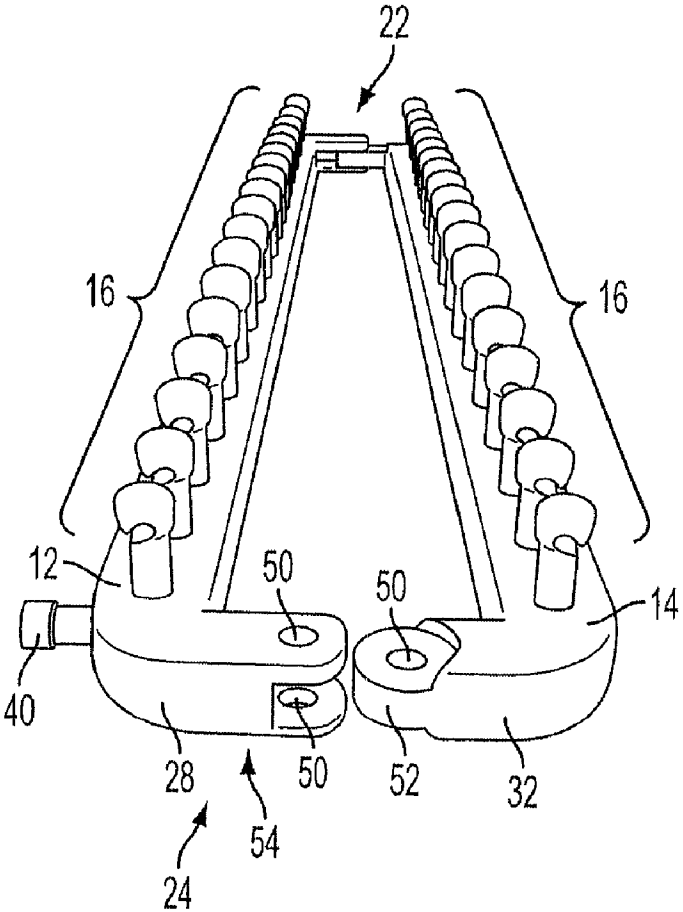
FIG. 5 illustrates a detailed, perspective view of ends of the knitting loom.

In one embodiment, the second end 28 of the first part 12 and the fourth end 32 of the second part 14 each have corresponding openings 50 configured to align on a same axis and receive the removable fastener 20 therein to hold the first and second parts in the first configuration. In an embodiment, as shown in detail in FIG. 5, at least a part 52 of the fourth end 32 of the second part 14 is received within a part 54 of the second end of the first part 12 in the first configuration. When the parts 52 and 54 are fit together, the openings 50 will align and allow for the fastener 20 to be inserted therein.

To allow for relative movement of first and second parts 12 and 14 (e.g., without separation of the parts), knitting loom has a hinge 48 connecting the first part 12 and the second part 14, so that the first part 12 and the second part 14 are pivotally attached and configured to rotate relative to each other via the hinge 48. For example, the hinge 48 may be provided at end 22 of the base structure 10. In an embodiment, the hinge 48 is attached to first end 26 of the first part 12 and third end 30 of second part 14. In another embodiment, the hinge 48 is formed from an attachment of first end 26 of first part 12 and third end 30 of second part 14.

In one embodiment, the hinge 48 is formed from the first end 26 of the first part 12 and the third end 30 of the second part 14 each have openings 56 configured to align on a same axis and to receive a pivot pin 18 therein to enable pivotal movement of the first and second parts 12 and 14. As shown in FIG. 2, first and second parts 12, 14 can be pivoted about pivot 18 to a closed position. In the closed position (a first configuration), removable fastener 20 can be inserted through end 24 to lock the parts 12 and 14. In this configuration, a user can knit an item in the round.

Figure 6:
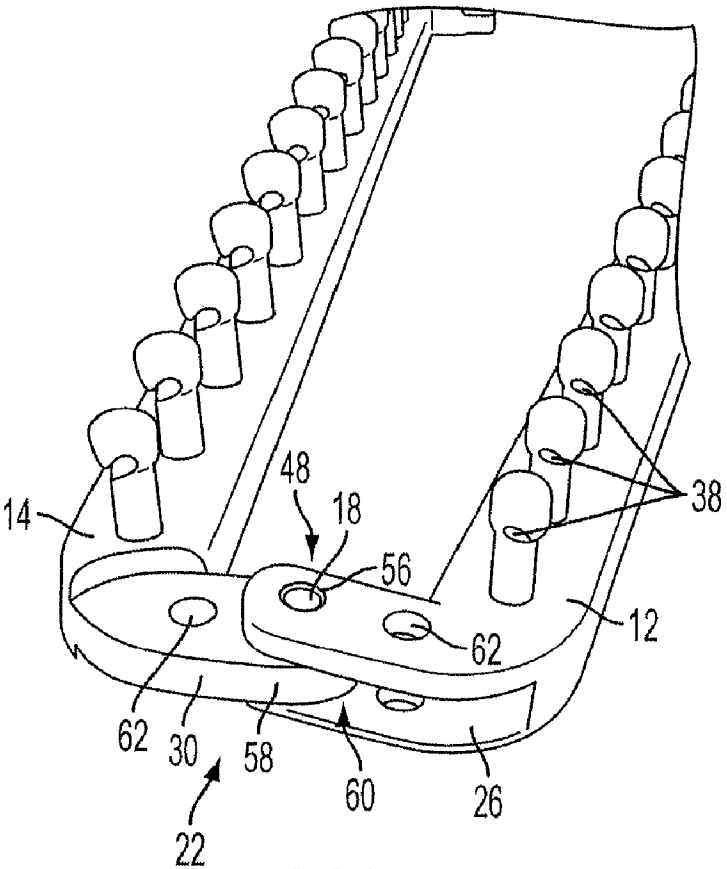
FIG. 6 illustrates a detailed, perspective view of hinged ends of the knitting loom.

In an embodiment, as shown in detail in FIG. 6, the hinge 48 comprises at least a part 58 of the third end 30 of the second part 12 being received within a part 60 of the first end 26 of the first part 12. The at least a part 58 of the third end 30 is configured to rotate within the part 60 of the first end 26 during movement of the first and second parts between the first configuration and the second configuration.

Figure 1:
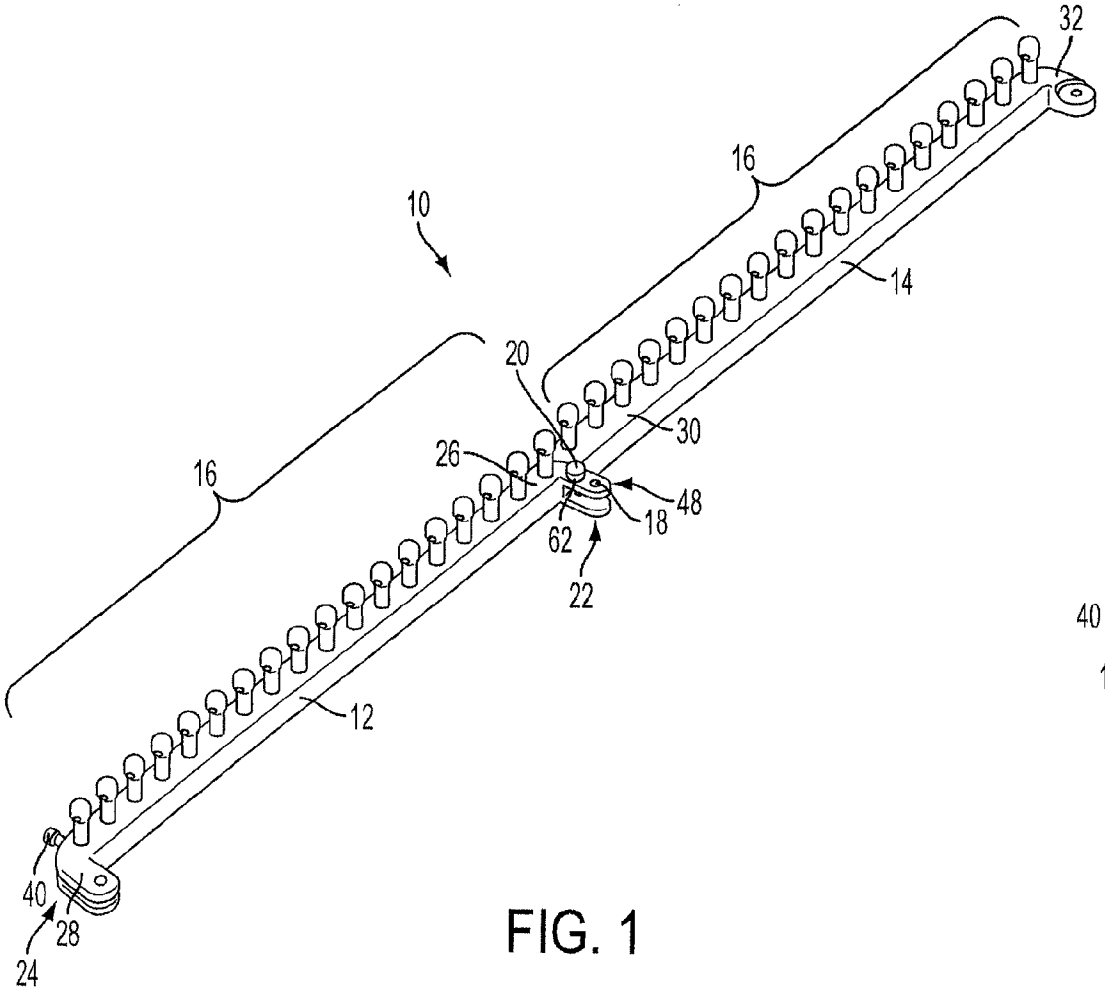
FIG. 1 illustrates a perspective view of the knitting loom of the present disclosure in a first configuration (or open, linear position) in accordance with an embodiment.

In accordance with another embodiment, when the knitting loom is moved to its second configuration (after removal of the fastener 20 and pivoting at end 22), the first part 12 and the second part 14 are configured to be moved and positioned in a second (open, linear) configuration wherein the first body 12 and the second body 14 are substantially linearly aligned, such as shown in FIG. 1. In one embodiment, the first end 26 of the first part 12 and the third end 30 of the second part 14 each have second corresponding openings 62 in addition and adjacent to opening(s) 50. For example, FIG. 6 illustrates second corresponding openings 62 provided adjacent to hinge 48. As shown in FIG. 1, the second corresponding openings 62 are configured to align on a same axis and to receive the removable fastener 20 therein to hold the first and second parts in the second, linear configuration. In an embodiment, when third end of the second part 14 is received within the first end of the first 12, the user can rotate the parts 12 and 14 until the openings 62 align and the loom is provided in a linear configuration. Then, the removable fastener 20 (which has been removed from end 24 of the base structure 10) can be used to lock the knitting loom in the open, linear position, whereby a user can knit an item in a straight length.

When using the knitting loom as disclosed herein (in either configuration), one of ordinary skill in the art would attach yarn to either one of the plurality of knitting pegs 16 or the yarn attachment peg 40 by knotting, for example. The yarn is then wrapped around the pegs 16 using the desired method to form knitted loops (e.g., slipped stitch method, selvedge method, flat panel knitting, double knit, etc.), and the loops are moved and woven until the desired amount or length of knitting by the user is achieved. To remove the garment, the loops can be removed from the pegs and the knitted item secured as desired.

Accordingly, the disclosed knitting loom is used for knitting an item, such as a garment. The hinged knitting loom allows for the loom to be positioned in more than one configuration for knitting. It allows for relative movement of parts/sides 12 and 14 with respect to each other. It also allows for its use in at least a closed (parallel) configuration and an open, linear configuration (e.g., for knitting).

The examples discussed herein provide that a single handloom may be used to perform a single knit, a double knit and/or a circular knit, for example. The loom may be a non-circular knitting loom that is shaped, not exclusively, as oblong, elliptical, and/or rectangular. In another embodiment, the loom may also be a substantially circular or oval loom. The base structure 10 of the loom may include, but is not limited to, having parts configured to form the following shapes in a first (closed) configuration: an ellipse, an oblong, a rectangle, a rounded rectangle, or an oval.

Additionally, reference to first and second parts and their respective ends is not meant to be limiting. Also, any reference regarding one end being received in the other should be understood to be not limiting in any way. That is, it should be understood that the receiving end and inserted ends with reference to either end 22 and/or 24 may be reversed. Moreover, it should be further understood that the ends may overlap and/or have an additional part that is attached thereto.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A knitting loom comprising:

a base structure having a first part and a second part;

the first part extending in a longitudinal direction having a first end and a second end, the first part having a plurality of knitting pegs provided between the first end and the second end;

the second part extending in a longitudinal direction having a third end and a fourth end, the second part having a plurality of knitting pegs provided between the third end and the fourth end;

the first end of the first part and the third end of the second part being hingedly connected together by a hinge such that the first part and the second part are configured to move relative to each other within a same plane such that the knitting loom is positioned in either in a first configuration wherein the first part and the second part are parallel to each other or a second configuration wherein the first part and the second part are provided at an angle relative to each other.

2. The knitting loom according to claim 1, wherein the second end of the first part and the fourth end of the second part each have corresponding openings configured to align on a same axis and to receive a removable fastener therein to hold the first and second parts in the first configuration.

3. The knitting loom according to claim 2, wherein at least a part of the fourth end of the second part is received within a part of the second end of the first part in the first configuration.

4. The knitting loom according to claim 1, wherein first part and the second part are substantially linear in the second configuration.

5. The knitting loom according to claim 2, wherein the first end of the first part and the third end of the second part each have second corresponding openings configured to align on a same axis and to receive the removable fastener therein to hold the first and second parts in the second configuration.

6. The knitting loom according to claim 1, wherein the hinge comprises at least a part of the third end of the second part being received within a part of the first end of the first part, and wherein the at least a part of the third end is configured to rotate within the part of the first end during movement of the first and second parts between the first configuration and the second configuration.

7. The knitting loom according to claim 6, wherein the first end of the first part and the third end of the second part each have corresponding openings configured to align on a same axis in the second configuration, and wherein the aligned corresponding openings are configured to receive a removable fastener therein to hold the first and second parts in the second configuration.

8. The knitting loom according to claim 1, wherein the first part and the second part have a space therebetween in the first configuration.

9. The knitting loom according to claim 1, wherein each of the plurality of knitting pegs of the first part and the second part are removably connected to their respective part.

10. The knitting loom according to claim 1, wherein the plurality of knitting pegs of the first part and the second part are spaced equidistant relative to one another.

11. A knitting loom comprising:

a first body extending in a longitudinal direction having a first end and a second end and having a plurality of knitting pegs extending therefrom;

a second body extending in a longitudinal direction having a third end and a fourth end and having a plurality of knitting pegs extending therefrom;

a hinge connecting the first body and the second body, the first body and the second body configured to rotate relative to each other via the hinge within a same plane;

the first body and the second body being configured to be provided in a closed configuration such the first body and the second body are parallel to each other and being configured to be provided in an open, linear configuration wherein the first body and the second body are substantially linearly aligned, wherein, in the closed configuration, the second end of the first body and the fourth end of the second body are locked in the closed configuration using a removable lock pin, and wherein, in the open, linear configuration, the first end of the first body and the third end of the second body are locked in the open, linear configuration using the removable lock pin.

12. A knitting loom according to claim 11, wherein the second end of the first body and the fourth end of the second body each have corresponding openings configured to align on a same axis in the closed configuration, and wherein the aligned corresponding openings are configured to receive the removable lock pin therein.

13. A knitting loom according to claim 11, wherein the first end of the first body and the third end of the second body each have corresponding openings configured to align on a same axis in the open, linear configuration, and wherein the aligned corresponding openings are configured to receive the removable lock pin therein.

14. The knitting loom according to claim 13, wherein at least a part of the fourth end of the second body is received within a part of the second end of the first body in the first configuration.

15. The knitting loom according to claim 11, wherein the hinge comprises at least a part of the third end of the second body being received within a part of the first end of the first body, and wherein the at least a part of the third end is configured to rotate within the part of the first end during movement of the first and second bodies between the first configuration and the second configuration.

16. The knitting loom according to claim 11, wherein the first body and the second body have a space therebetween in the first configuration.

17. The knitting loom according to claim 11, wherein each of the plurality of knitting pegs of the first body and the second body are removably connected to their respective part.

18. The knitting loom according to claim 11, wherein the plurality of knitting pegs of the first body and the second body are spaced equidistant relative to one another.

* * * * *